US006526256B2

(12) United States Patent
Yoshie et al.

(10) Patent No.: US 6,526,256 B2
(45) Date of Patent: Feb. 25, 2003

(54) FINISHING APPARATUS, SHEET PROCESSING METHOD, IMAGE FORMING METHOD AND IMAGE FORMING APPARATUS

(75) Inventors: Kohji Yoshie, Kanagawa (JP); Hiroyuki Wakabayashi, Tokyo (JP); Masato Hattori, Tokyo (JP); Tadashi Tenda, Tokyo (JP); Eiichiro Nishizawa, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/928,791

(22) Filed: Aug. 13, 2001

(65) Prior Publication Data

US 2002/0025207 A1 Feb. 28, 2002

(30) Foreign Application Priority Data

Aug. 21, 2000 (JP) ..... 2000-249689

(51) Int. Cl.[7] ..... G03G 15/00
(52) U.S. Cl. ..... 399/407; 270/39.01
(58) Field of Search ..... 399/407, 410; 270/37, 58.23, 45, 58.08, 39.01, 39.06, 39.08, 39.09

(56) References Cited

U.S. PATENT DOCUMENTS 6,006,065 A * 12/1999 Seki ..... 399/407

FOREIGN PATENT DOCUMENTS

JP 11-11783 * 1/1999
JP 11-157247 * 6/1999

* cited by examiner

*Primary Examiner*—Quana M. Grainger
(74) *Attorney, Agent, or Firm*—Frishauf, Holtz, Goodman & Chick, P.C.

(57) ABSTRACT

An image-forming apparatus is provided which can conduct folding processing that is suitable for a process to form an image on a sheet. The image forming apparatus includes a first folding device and a second folding device both of which conduct folding processing while conveying a sheet, a controller to control both of the first folding device and the second folding device, and a selector to select a two-folding mode or a three-folding mode. The controller controls the first folding device so as to eject the sheet after folding the sheet double when the two-folding mode is selected by the selector, while the controller controls the first folding device so as to fold the sheet double, and then, further controls the second folding device so as to eject the sheet after further folding the sheet in three when the selector selects the three-folding mode.

9 Claims, 12 Drawing Sheets

SHEET EJECTION SECTION
S2
G2
S1
G1

INTERMEDIATE STACKER
S2
G2
S1
G1

FIRST FOLDING PROCESS
S1
G1
SA
S2
G2
SA

SECOND FOLDING PROCESS
S1
G1
SA
SB
S2
G2
SA
SB

FIG. 6 ( a )
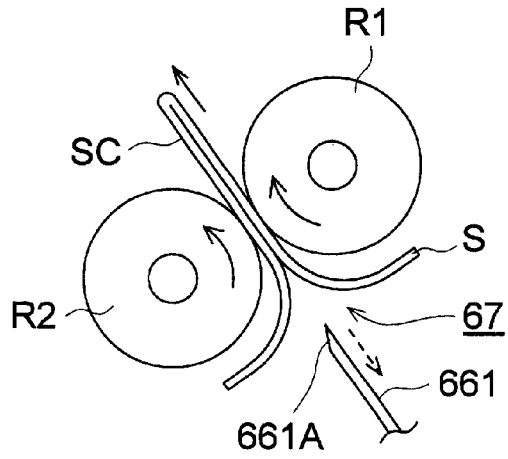
FIG. 6 ( b )
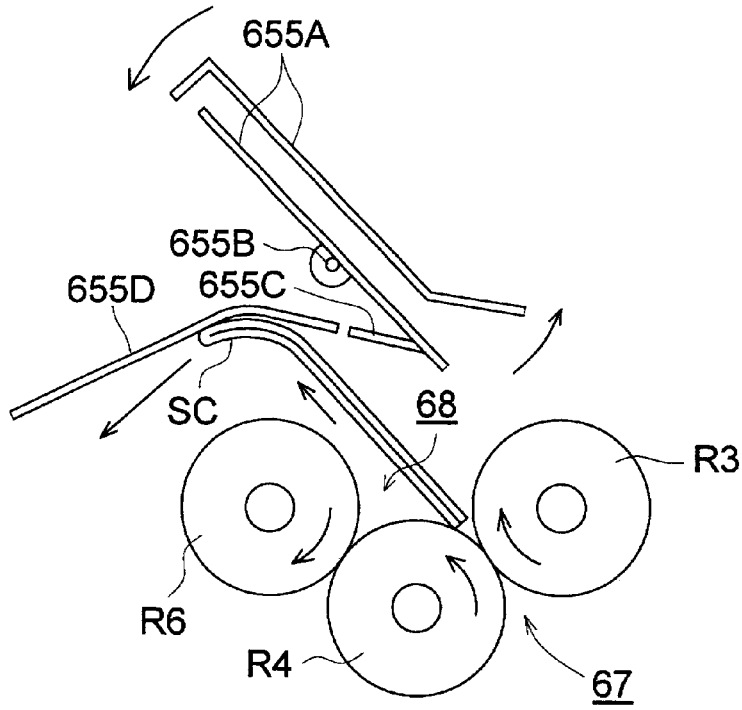

FIG. 10 ( a )
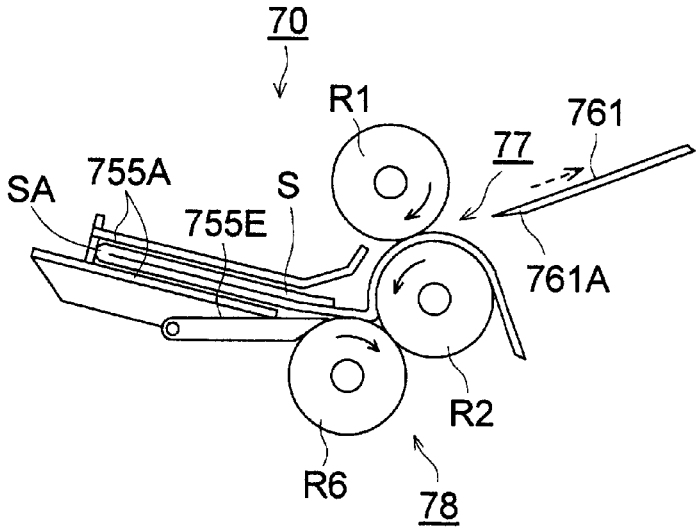
FIG. 10 ( b )
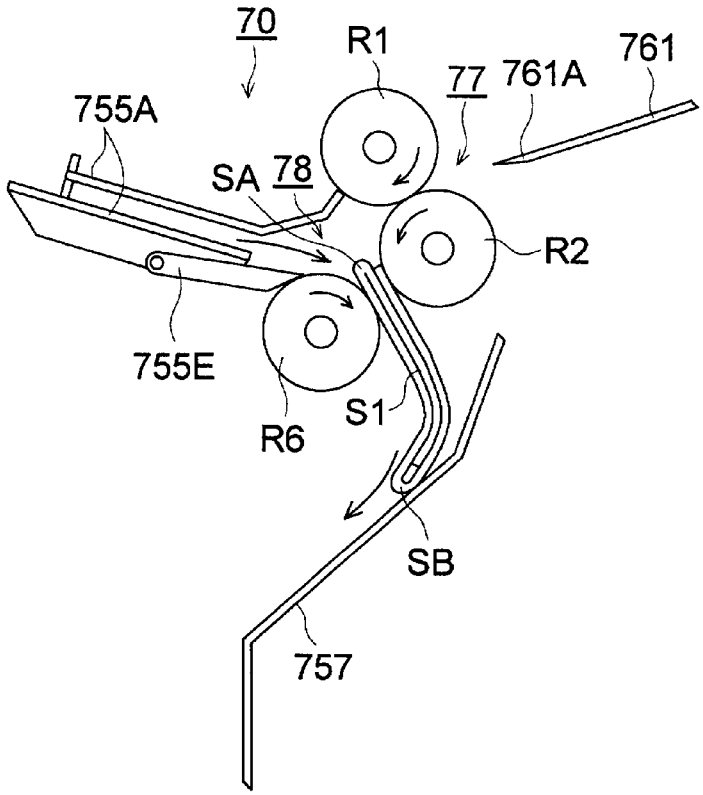

FINISHING APPARATUS, SHEET PROCESSING METHOD, IMAGE FORMING METHOD AND IMAGE FORMING APPARATUS

BACKGROUND OF THE INVENTION

The present invention relates to a technology to make a document which is folded in two or in three, and in particular, to a technology to conduct folding processing that is suitable for a process to form an image on a sheet.

A processing apparatus to conduct folding processing for a sheet is widely applied in the field of bookbinding, and a processing apparatus to fold a sheet or to fold relatively small number of sheets is also widely applied as one to make a sealed document for mail.

Conventional folding processing apparatuses are large-sized and expensive, and are intended to conduct a large amount of processing at high speed.

However, depending on a type of a document, there are a good many documents which are relatively small in quantity and require different handling, in addition to a large amount of unified documents. In the case of a sealed document for direct mailing, for example, a document wherein an individual slip carries different information such as an address and other information sometimes needs to be folded, and in that case, manual operations to group individual different documents are needed before or after the documents are processed in the folding process apparatus.

The conventional apparatus to conduct a large amount of uniform processing has a problem that overall efficiency cannot be improved.

SUMMARY OF THE INVENTION

An object of the invention is to solve the aforesaid problem in the conventional folding processing apparatus in the case of processing documents wherein a group of documents in a small quantity are different from each other and/or wherein individual slips are different from each other, and to provide a small-sized and inexpensive finishing apparatus which can cope flexibly with various applications and can make folded documents at high overall efficiency and an image forming apparatus having therein the finishing apparatus.

Accordingly, to overcome the shortcomings of the prior art, the above-mentioned object of the present invention can be attained by an image-forming apparatus and finishers described as follows.

(1) An image forming apparatus, comprising: a first folding device and a second folding device, both of which conduct folding processing while conveying a sheet; a controller to control both of the first folding device and the second folding device; and a selector that makes it possible to select a two-folding mode or a three-folding mode; wherein the controller controls the first folding device so as to eject the sheet after folding the sheet double when the two-folding mode is selected by the selector, while the controller controls the first folding device so as to fold the sheet double, and then, further controls the second folding device so as to eject the sheet after further folding the sheet in three when the selector selects the three-folding mode.

(2) The image-forming apparatus of item 1, wherein the first folding device comprises: a first conveyance-folding device that conveys the sheet; and a knife-shaped folding member to feed the sheet into the first conveyance-folding device in a state that a folded portion of the sheet is its forefront, and the second folding device comprises: a second conveyance-folding device that folds and conveys the sheet; and a stop guiding member to stop a leading edge of the sheet conveyed by the second conveyance-folding device.

(3) The image-forming apparatus of item 2, wherein the stop guiding member guides the sheet along a conveyance path of the sheet in a three-folding process, while the stop guiding member retreats from the conveyance path in a two-folding process.

(4) The image-forming apparatus of item 1, further comprising a binding device, wherein the binding device, the first folding device and the second folding device are successively arranged in a conveyance direction of the sheet.

(5) The image-forming apparatus of item 4, wherein the binding device comprises an intermediate stacker inclined, and the first folding device is arranged along a conveyance path that is inclined in a direction opposite to that of the intermediate stacker.

(6) The image-forming apparatus of item 4, wherein the binding device comprises an intermediate stacker inclined, and the first folding device is arranged along a conveyance path that is inclined in the same direction as that of the intermediate stacker.

(7) The image-forming apparatus of item 1, further comprising a binding device, wherein the binding device is arranged on a downstream side in a conveyance path of the sheet with respect to the first folding device.

(8) The image-forming apparatus of item 1, further comprising: a stacking member disposed on the upstream side of the first folding device to stack a plurality of sheets on it.

(9) An image-forming method, comprising the steps of: forming an image on an obverse surface of a sheet; conveying the sheet on which the image is formed; folding the sheet at a first position that is about ⅔ of its total length from a leading edge of the sheet in a conveyance direction of the sheet so that the obverse surface becomes convex, in a first folding process; and folding the sheet at a second position that is about ⅓ of its total length from the leading edge of the sheet in the conveyance direction of the sheet so that the obverse surface becomes convex, in a second folding process.

(10) The image-forming method of item 9, wherein the first folding process and the second folding process are conducted for the sheet that is conveyed so that a tip of the image is positioned at the leading edge of the sheet.

(11) An image-forming apparatus, comprising: an image-forming device to form an image on an obverse surface of a sheet; a first folding device to convey the sheet on which the image is formed and to fold the sheet at a first position that is about ⅔ of its total length from a leading edge of the sheet in a conveyance direction of the sheet so that the obverse surface becomes convex; and a second folding device to fold the sheet, folded by the first folding device, at a second position that is about ⅓ of its total length from the leading edge of the sheet in the conveyance direction of the sheet so that the obverse surface becomes convex.

(12) The image-forming apparatus of item 11, wherein a folding process conducted by the first folding device is only enabled, and a delivering operation of the sheet, which is folded double, is enabled.

(13) The image-forming apparatus of item 11, wherein the first folding device comprises a knife-shaped folding member.

(14) The image-forming apparatus of item 11, wherein the second folding device comprises: a conveyance-folding device to convey and fold the sheet; and a stop guiding member to stop a leading edge of the sheet conveyed by the conveyance-folding device.

(15) A method for finishing a sheet on which an image is formed, wherein a first folding device folds the sheet in case of folding the sheet double, while a second folding device further folds the sheet after the first folding device folds the sheet in case of folding the sheet in three.

(16) A finisher for finishing a sheet on which an image is formed, comprising: a first folding roller; a second folding roller contacting the first folding roller; a knife-shaped folding member to insert a folded portion of the sheet into a nip formed between the first folding roller and the second folding roller; a third folding roller contacting the second folding roller at a downstream side of the first folding roller in a conveyance direction of the sheet; and a stopper guide member to stop the sheet conveyed by the second folding roller; wherein a combination of the first folding roller, the second folding roller and the knife-shaped folding member folds the sheet as a first folding process, while a combination of the second folding roller, the third folding roller and the stopper guide member folds the sheet as a second folding process.

(17) A finisher for finishing a sheet on which an image is formed, comprising: a first folding roller; a second folding roller contacting the first folding roller; a third folding roller; a conveyance roller contacting the third folding roller; a knife-shaped folding member to insert a folded portion of the sheet into a nip formed between the first folding roller and the second folding roller; a fourth folding roller contacting the third folding roller at a downstream side of the conveyance roller; and a stopper guide member to stop the sheet conveyed by the third folding roller and the conveyance roller, wherein a combination of the first folding roller, the second folding roller and the knife-shaped folding member folds the sheet as a first folding process, while a combination of the third folding roller, the fourth folding roller, the conveyance roller and the stopper guide member folds the sheet as a second folding process.

(18) An image-forming apparatus, comprising: an image forming device to form images on both obverse and reverse surfaces of a sheet in such a manner that a directions of the images are maintained at a constant in respect to a leading edge and a trailing edge of the sheet conveyed in a conveyance path; and a finisher, comprising a folding device to convey the sheet delivered from the image forming device and to fold the sheet at first and second positions that are about ⅓ and ⅔ of its total length from a leading edge of the sheet in a conveyance direction of the sheet so that the obverse surface becomes convex.

(19) The image-forming apparatus of item 18, wherein the image forming device feeds the sheet into the finisher in such a manner that a rear end of an image comes to the leading edge of the sheet conveyed in the folding device, and the finisher comprises a reversing member to reverse the sheet in terms of leading and trailing sides of the sheet in its conveyance direction, and the folding device folds the sheet at a position which is about ⅓ of a total length of the sheet after folding the sheet at a position which is about ⅔ of the total length.

(20) The image-forming apparatus of item 18, wherein the image forming device feeds the sheet into the finisher in such a manner that the reverse surface of the sheet faces upward.

(21) The image-forming apparatus of item 18, wherein the folding device comprises a stacking member to stack a plurality of sheets on it.

(22) The image-forming apparatus of item 18, wherein the finisher comprises a binding device, and the binding device and the folding device are arranged in succession from an upstream side in a conveyance direction of the sheet fed from the image-forming device.

(23) The image-forming apparatus of item 18, wherein the finisher comprises a binding device, and the folding device and the binding device are arranged in succession from an upstream side in a conveyance direction of the sheet fed from the image-forming device.

Further, to overcome the abovementioned problems, other image-forming apparatus and finishers, embodied in the present invention, will be described as follow:

Structure 1.

An image forming apparatus having therein a first and second folding means to conduct folding processing while conveying a sheet, a selecting means to select a two-folding mode or a three-folding mode, and a control means, wherein when the two-folding mode is selected by the selecting means, the control means conducts the control to operate the first folding means to fold a sheet double to eject, while, when the three-folding mode is selected by the selecting means, the control means conducts the control to operate the first folding means to fold a sheet and to operate the second folding means to further fold to fold in three to eject.

Structure 2.

The image forming apparatus according to Structure 1 wherein the first folding means has a first conveyance folding means that conveys a sheet and a knife-shaped folding member that feeds a sheet in the first conveyance folding means with the folded portion of the sheet being in the forefront, and the second folding means has a second conveyance folding means that folds a sheet and conveys it and a stop guiding member that bends a sheet by stopping a movement of a leading edge of the sheet conveyed by the second conveyance folding means.

Structure 3.

The image forming apparatus according to Structure 2, wherein the stop guiding member guides a sheet along a conveyance path for a sheet in the case of three-folding processing, and the stop guiding member retreats from the conveyance path for a sheet in the case of two-folding processing.

Structure 4.

The processing apparatus according to either one of the Structures 1–3, wherein a binding means is provided, and the binding means, the first folding means and the second folding means are arranged in succession along the conveyance path for a sheet.

Structure 5.

The image forming apparatus according to Structure 4, wherein the binding means has an inclined intermediate stacker, and the first folding means is arranged along the conveyance path that is inclined in the direction opposite to that of the intermediate stacker.

Structure 6.

The image forming apparatus according to Structure 4, wherein the binding means has an inclined intermediate stacker, and the first folding means is arranged along the conveyance path inclined in the same direction as in the intermediate stacker.

Structure 7.

The image forming apparatus according to either one of Structures 1–3, wherein a binding means is provided, and the binding means is arranged at the downstream side of the first folding means in the conveyance path for a sheet.

Structure 8.

The image forming apparatus according to either one of Structures 1–7, wherein a stacking means on which a plurality of sheets are stacked is provided at the upstream side of the folding means.

Structure 9.

An image forming method having therein an image forming process to form an image on at least the obverse of a sheet, a first folding process to convey an image-formed sheet, and to fold the sheet at the position that is about ⅔ of the total length of the sheet from its leading edge in the conveyance direction so that the image-formed obverse may be convex, and a second folding process to fold the sheet folded in the first folding process at the position that is about ⅓ of the total length of the sheet from its leading edge in the conveyance direction so that the image-formed surface may be convex.

Structure 10.

The image forming method according to Structure 9, wherein the first folding process and the second folding process are conducted for the sheet that is conveyed so that a tip of an image is positioned at a leading edge of the sheet.

Structure 11.

An image forming apparatus having therein an image forming means to form an image on at least the obverse of a sheet, a first folding process to convey an image-formed sheet, and to fold the sheet at the position that is about ⅔ of the total length of the sheet from its leading edge in the conveyance direction so that the image-formed obverse may be convex, and a second folding means to fold the sheet folded in the first folding process at the position that is about ⅓ of the total length of the sheet from its leading edge in the conveyance direction so that the image-formed surface may be convex.

Structure 12.

The image forming apparatus according to Structure 11, wherein only folding processing by the first folding means is conducted, and the sheet folded in two can be ejected.

Structure 13.

The image forming apparatus according to Structure 11 or Structure 12, wherein the first folding means is provided with a knife-shaped folding member.

Structure 14.

The image forming apparatus according to either one of Structure 11–Structure 13, wherein the second folding means has therein a conveyance/folding means that conveys a sheet and folds it and a stopper guide member that folds a sheet by stopping the movement of a leading edge of the sheet conveyed by the conveyance/folding means.

Structure 15.

A sheet processing method for finishing the image-formed sheet, wherein, when folding a sheet in two, the folding is performed by a first folding means, while, when folding a sheet in three, the first folding means conducts folding and then a second folding means conducts folding.

Structure 16.

A finishing apparatus having therein a first folding roller, a second folding roller that comes in contact with the first folding roller, a knife-shaped folding member that feeds the folded portion of a sheet into a gap between the first folding roller and the second folding roller, a third folding roller that comes in contact with the second folding roller at the downstream side of the first folding roller in the conveyance direction, and a stopper guide member that stops an advance of the sheet conveyed by the second folding roller, wherein, the first folding is conducted by the first folding roller, the second folding roller and the knife-shaped folding member, while, the second folding is conducted by the second folding roller, the third folding roller and the stopper guide member.

Structure 17.

A finishing apparatus having therein a first folding roller, a second folding roller that comes in contact with the first folding roller, a third folding roller, a conveyance roller that comes in contact with the third folding roller, a knife-shaped folding member that feeds the folded portion of a sheet into a gap between the first folding roller and the second folding roller, a fourth folding roller that comes in contact with the third folding roller at the downstream side of the conveyance roller, and a stopper guide member that stops an advance of the sheet conveyed by the third folding roller and the conveyance roller, wherein, the first folding is conducted by the first folding roller, the second folding roller and the knife-shaped folding member, while, the second folding is conducted by the third folding roller, the fourth folding roller, the conveyance roller and the stopper guide member.

Structure 18.

An image forming apparatus having therein an image forming means capable of forming images on both the obverse and the reverse of a sheet in a way that no change is made on relationship between the leading edge and the trailing edge of the conveyed sheet in terms of the image direction, and a finishing apparatus equipped with a folding means that conveys the sheet ejected from the image forming means and conducts folding of a sheet at the positions which are about ⅓ and ⅔ of the total length of the sheet from its leading edge in the conveyance direction so that the obverse of the sheet may be convex.

Structure 19.

The image forming apparatus according to Structure 18, wherein the image forming means feeds a sheet into the finishing apparatus in a way that a rear end of an image comes to a leading edge of the sheet that is conveyed by the folding means, the finishing apparatus has a reversing means that inverts the sheet in the conveyance direction in terms of front and rear, and the folding means conducts folding at the position which is about ⅔ of the total length of the sheet and then, conducts folding at the position which is about ⅓.

Structure 20.

The image forming apparatus according to Structure 18 or Structure 19, wherein the image forming means feeds a sheet into the finishing apparatus with the reverse of the sheet facing upward.

Structure 21.

The image forming apparatus according to either one of Structure 18–Structure 20, wherein the folding means has a stacking means on which a plurality of sheets are stacked.

Structure 22.

The image forming apparatus according to either one of Structure 18–Structure 21, wherein a binding means is provided, and a binding processing means and a folding means are arranged in succession from the upstream side along the conveyance path into which the sheet has been fed.

Structure 23.

The image forming apparatus according to either one of Structure 18–Structure 21, wherein a binding means is provided, and a folding means and a binding means and are arranged in succession from the upstream side along the conveyance path into which the sheet has been fed.

BRIEF DESCRIPTION OF THE DRAWINGS

Other objects and advantages of the present invention will become apparent upon reading the following detailed description and upon reference to the drawings in which:

FIGS. 6(*a*) and 6(*b*) are diagrams showing operations of main portions of a folding means in the case of folding in two;

FIGS. 10(*a*) and 10(*b*) are diagrams showing operations of main portions of a folding means in the case of folding in three;

DETAILED DESCRIPTION OF THE PREFERRED EMBODIMENT (1) Image Forming Apparatus

Figure 1:
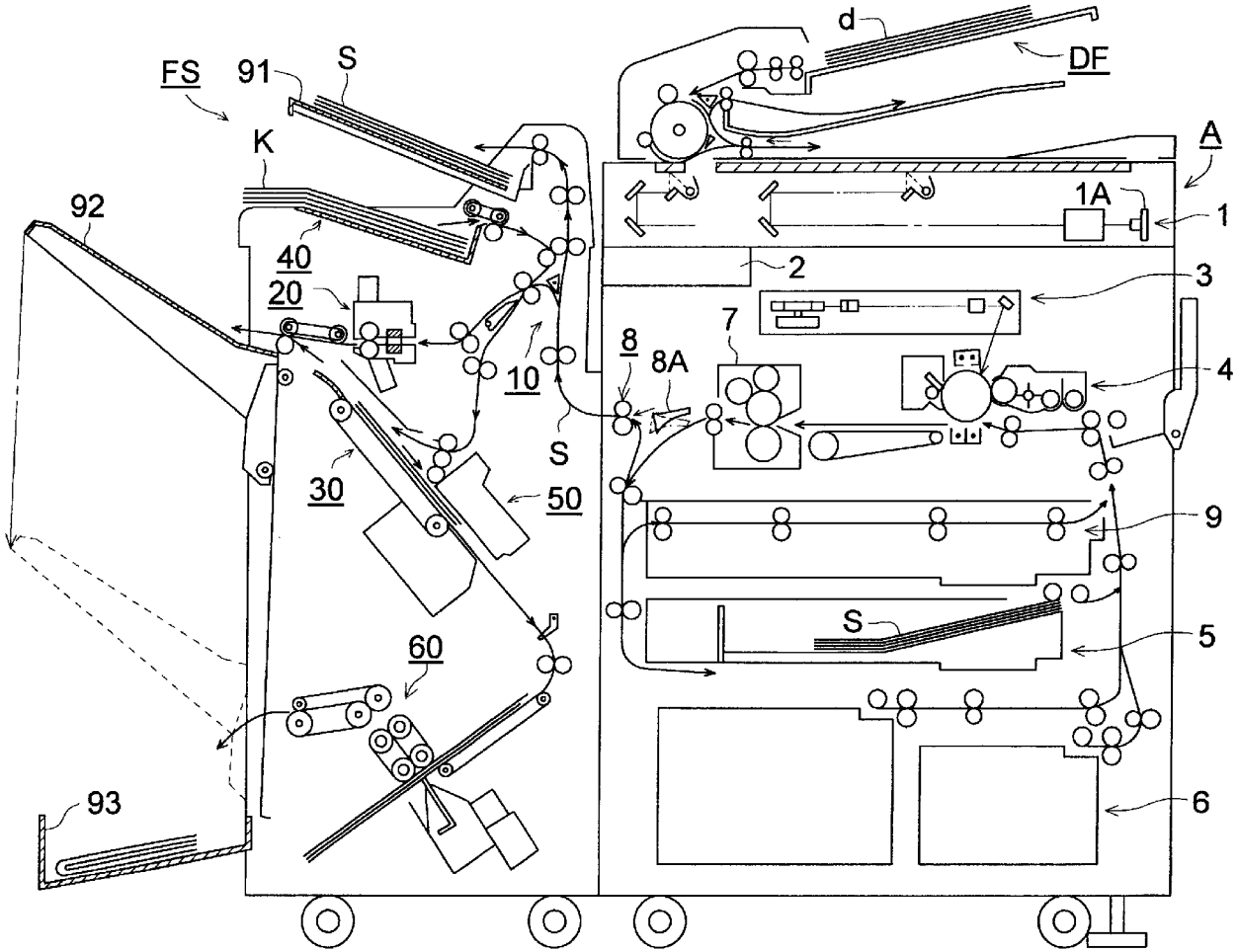
FIG. 1 is a diagram showing the overall structure of an image forming apparatus related to Embodiment 1 of the invention.

FIG. 1 is a diagram showing the overall structure of an image forming apparatus related to an embodiment of the invention. The image forming apparatus related to an embodiment of the invention is composed of image forming apparatus main body A and finishing apparatus FS.

The image forming apparatus main body A is provided with image reading section 1, image processing section 2, image writing section 3, image forming section 4, cassette sheet feeding section 5, large capacity sheet feeding section (LCT) 6, fixing unit 7, sheet ejection section 8 and reverse side image forming sheet feeding section 9.

The image forming apparatus main body A further has on its top automatic document feeding device DF. On the illustrated left side of the image forming apparatus main body A representing sheet ejection section 8 side, there is connected finishing apparatus FS.

Document d placed on a document stand of the automatic document feeding device DF is conveyed in the direction of an arrow, and is read by CCD image sensor 1A of image reading section 1.

Analog signals subjected to photoelectric conversion by CCD image sensor 1A are subjected to analog processing, A/D conversion, shading correction and image compression processing in image processing section 2, and signals are sent to image writing section 3.

In the image writing section 3, output from a semiconductor laser is radiated on a photoreceptor drum of image forming section 4 to form a latent image. In the image forming section 4, there are conducted processes including charging, exposure, developing, transferring, separating and cleaning, and images are transferred onto sheet S conveyed from cassette sheet feeding section 5 or large capacity sheet ejection section 6. The image writing section 3, the image forming section 4 and fixing unit 7 constitute an image forming means. Sheet S carrying images is subjected to fixing by the fixing unit 7, and is fed into finishing apparatus FS from sheet ejection section 8. Or, sheet S that is fed into reverse side image forming sheet feeding section 9 by conveyance path switching plate 8A with its one side subjected to image processing is subjected again to reverse side image processing in the image forming section 4, and then, is fed into sheet finishing apparatus FS from sheet ejection section 8.

Switches to three occasions including an occasion where image-formed sheet S is ejected, as it is, to finishing apparatus FS in a single-side mode, an occasion where image-formed sheet S is ejected to finishing apparatus FS after being inverted in terms of obverse and reverse in a single-side mode, and an occasion where a sheet having images on its one side is fed into reverse side image forming sheet feeding section 9 in a two-side mode. In the two-side image forming mode, sheet S having images on its both sides is ejected with images on the reverse side facing upward, and is fed into finishing apparatus FS from image forming apparatus main body A.

Figure 3:
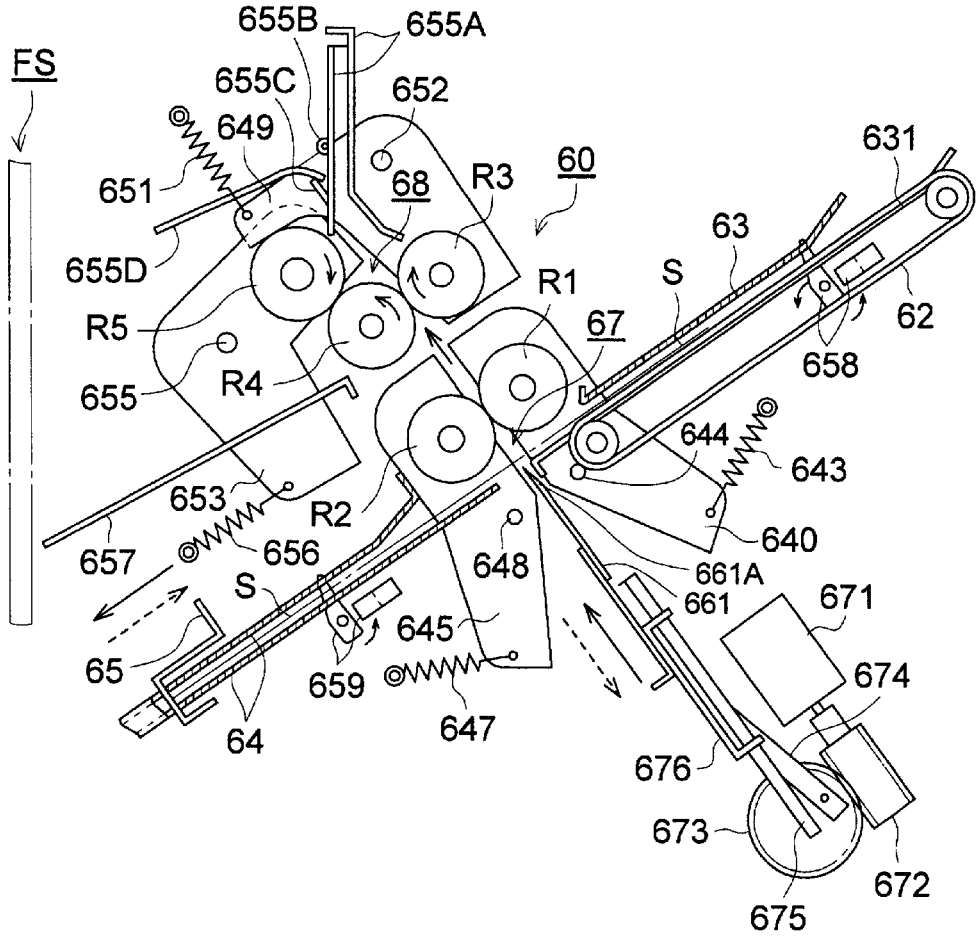
FIG. 3 is a front view of a folding means.
Figure 4:
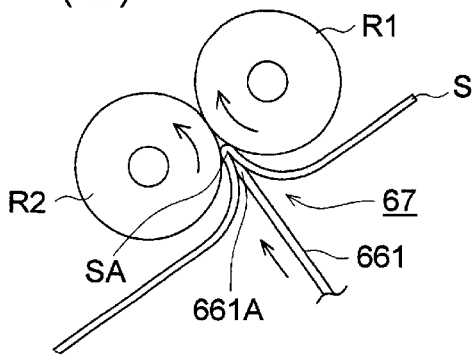
FIGS. 4(*a*)–4(*c*) are diagrams showing operations of main portions of a folding means in the case of folding in three.
Figure 4:
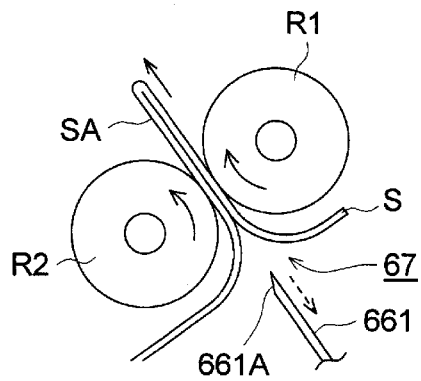
Figure 4:
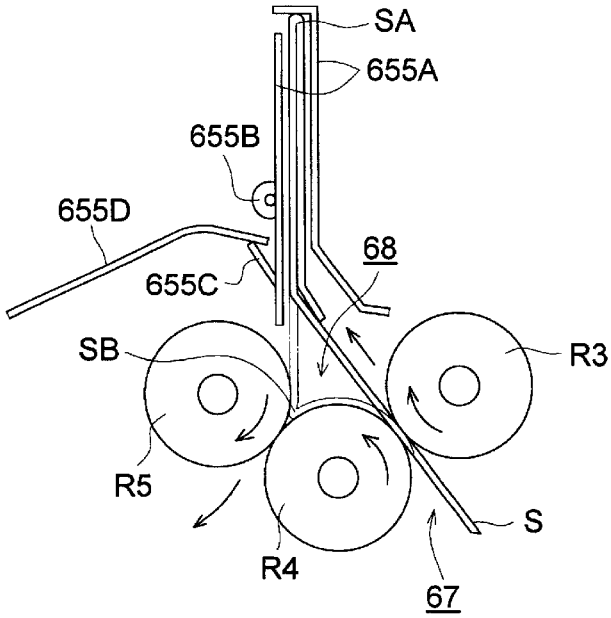

On the finishing apparatus FS, there are arranged, from end to end, almost vertically from the illustrated upper portion fixed sheet ejection tray 91, cover feeding means 40 on which covers K are placed, shift processing conveyance section 20, a binding means composed of intermediate stacker 30 and stapler 50, and folding means 60 (explained in detail in FIGS. 3, 4(*a*) and 4(*b*) and 5(*a*)–5(*d*)).

On the upper portion on the right side in the illustration of the finishing apparatus FS, there is arranged entrance conveyance section 10. On the left side of the finishing apparatus FS in the illustration, there are arranged fluctuating sheet ejection tray 92 on which end-bound and shift-processed sheets are stacked and fixed sheet ejection tray 93 on which processed sheets folded in three or folded in two are stacked.

(2) Embodiment 1

Figure 2:
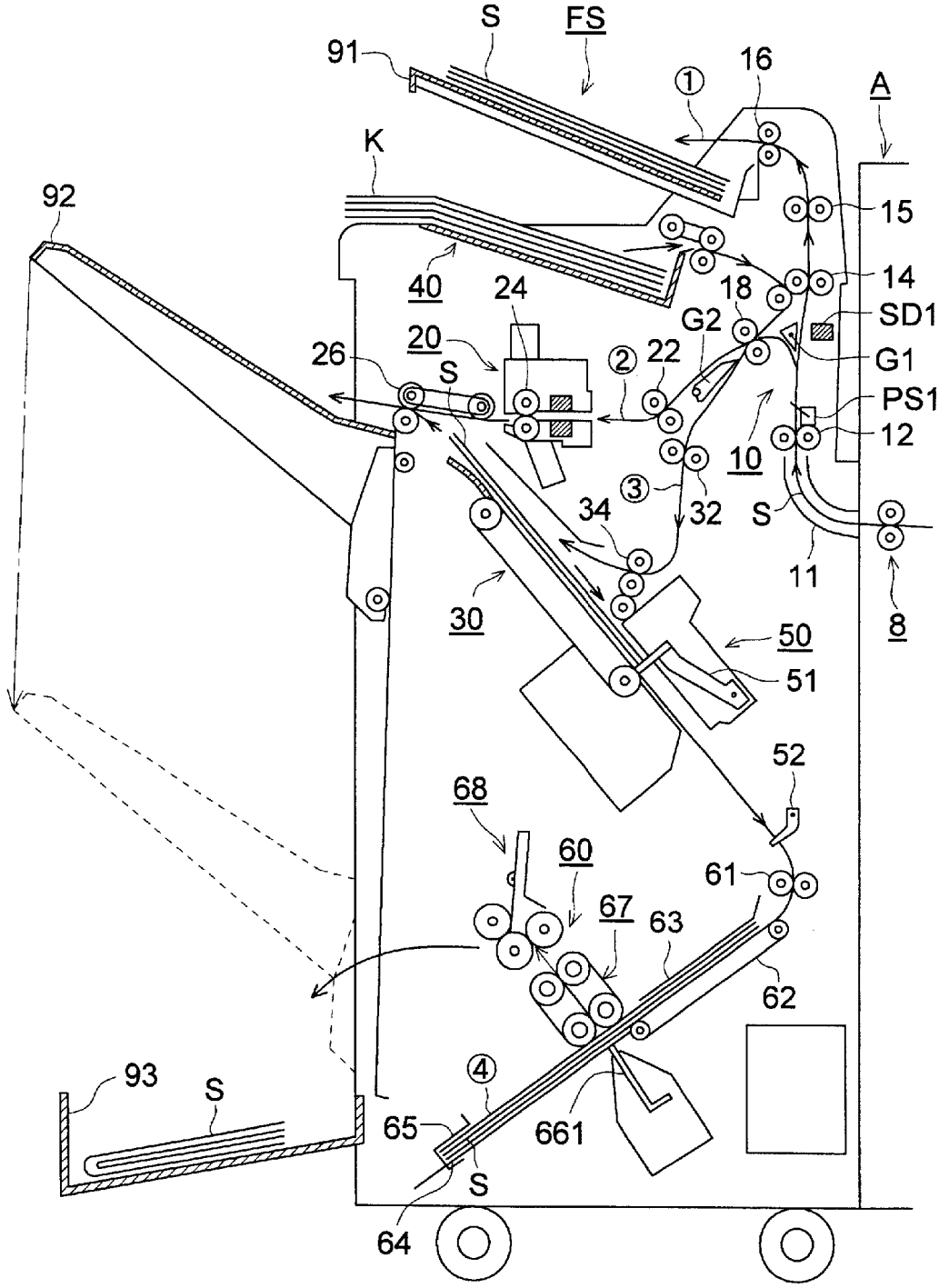
FIG. 2 is a diagram showing a flow of a sheet in a finishing apparatus related to Embodiment 1 of the invention.

FIG. 2 is a diagram showing a flow of sheet S in finishing apparatus FS related to Embodiment 1 of the invention.

The finishing apparatus FS is installed with its position and height adjusted so that accepting section 11 for sheet S ejected out of image forming apparatus main body A may agree, in terms of position, with sheet ejection section 8 of the image forming apparatus main body A.

At the accepting section 11, there are provided conveyance rollers 12, and at the downstream side of the conveyance rollers 12, there are arranged a first conveyance path (1) on the upper step, a second conveyance path (2) on the medium step, and a third conveyance paths (3) and a fourth conveyance path (4) both on the lower step.

How sheet S is conveyed in the first conveyance path (1)–fourth conveyance path (4) will be explained as follows.

(2)-1. Simple Sheet Ejection

The first conveyance path (1) is a sheet ejection path through which image-formed sheet S is ejected to be stacked in the order of ejection. In the sheet ejection mode to use the first conveyance path (1), gate G1 opens the first conveyance path (1) to close a path to conveyance roller 18. The image-formed sheet S ejected out of the image forming apparatus main body A is guided in the accepting section 11 to be conveyed by conveyance rollers 12, and thereby a length of the sheet S in the direction of the conveyance is detected by entrance section sensor PS1 for detection of entrance passage. The sheet S is guided by gate G1 to enter the first conveyance path (1), and is conveyed by conveyance rollers 14, 15 and 16 to be ejected onto the fixed sheet ejection tray 91.

(2)-2. Shift Sheet Ejection

The second conveyance path (2) is a conveyance path through which the image-formed sheet S is ejected onto fluctuating sheet ejection tray 92 after being subjected to grouping processing to be shifted in the conveyance transverse direction (direction perpendicular to the conveyance direction, the same shall apply hereinafter) for each prescribed number of sheets such as each number of documents, for example. In the mode to use this conveyance path, the gate G1 closes the first conveyance path (1) to open a path to conveyance rollers 18, and gate G2 opens the second conveyance path (2) to close the third conveyance path (3). The sheet S conveyed by the conveyance rollers 12 is conveyed to the second conveyance path (2), and is conveyed to shift processing section 20 by conveyance rollers 22. Conveyance rollers 24 in the shift processing section 20 have a shift conveyance function to shift in the conveyance transverse direction directly after receiving the leading edge of the sheet S and to convey the sheet S. The sheet S which has passed the shift processing section 20 is ejected onto fluctuating sheet ejection tray 92 by sheet ejection rollers 26.

(2)-3. Binding Processing

The third conveyance path (3) is a conveyance path for conducting binding processing for each prescribed number of sheets S, such as, for example, each number of documents. In the mode to use this conveyance path, the gate G1 closes the first conveyance path (1) to open a path to conveyance rollers 18, and gate G2 closes the second conveyance path (2) to open the third conveyance path (3). The sheet S is conveyed by conveyance rollers 18, 32 and 34 to be fed into intermediate stacker 30. When the trailing edge of the sheet S leaves the conveyance rollers 34, the sheet S slides down along the intermediate stacker 30 to hit movable stopper 51, and stops. The intermediate stacker 30 serves as a stacking means on which sheets S are stacked and as a reversing means that inverts the sheet S in the conveyance direction in terms of front and rear.

When sheets S in quantity of the prescribed number, for example, sheets S equivalent to the number of sheets of documents in terms of quantity are stacked on the intermediate stacker 30, stapler 50 operates to conduct binding processing.

In the binding processing mode, it is possible to append a cover, a back cover or an interleaf to a bundle of sheets S. Sheet K for a cover, a back cover or an interleaf is fed from sheet feeding means 40 and is supplied to intermediate stacker 30. In the mode to append sheet K, when sheets K set to sheets S in quantity of the prescribed number are appended, stapler 50 operates to conduct binding processing for a bundle of sheets.

The bundle of sheets thus bound are ejected onto fluctuating sheet ejection tray 92 by a conveyance belt of intermediate stacker 30 and by sheet ejection rollers 26.

(2)-4. Folding Processing

The fourth conveyance path (4) is a conveyance path for ejecting image-formed sheet S to fixed sheet ejection tray 93 by folding in three or by folding in two, and the sheet S passes through the third conveyance path (3) and passes through movable stopper 51 located at a shunting position to be conveyed to the fourth conveyance path (4).

First, processing to fold sheet S in three in the fourth conveyance path (4) will be explained in detail, referring to FIGS. 3 and 4.

FIG. 3 is a front view of folding means 60, and FIG. 4 is a diagram showing operations of main portions of the folding means 60 in the case of folding in three.

The folding means 60 has therein first folding means 67 composed of folding roller R1 representing a first folding roller constituting a first conveying/folding means, folding roller R2 representing a second folding roller constituting a first conveying/folding means and knife-shaped folding member 661, and second folding means 68 composed of conveyance roller R3, folding roller R4 representing a third folding roller constituting a second conveying/folding means and folding roller R5 representing a fourth folding roller constituting a second conveying/folding means. Though each of the first conveying/folding means and the second conveying/folding means is composed of folding rollers R1, R2, R4 and R5 respectively, it is also possible to construct these conveying/folding means with belts and rollers.

In the mode to conduct processing of folding in three, sheet S is conveyed to intermediate stacker 30 through the aforesaid conveyance path. In this mode, the movable stopper 51 is in the shunting position, and sheet S passes through intermediate stacker 30 and descends to movable stopper 52. At the stage where sheets S in quantity of the prescribed number (for example, maximum three sheets) are stacked at the position of the movable stopper 52, the movable stopper 52 retreats, and sheets S are conveyed to conveyance belt 62 by conveyance rollers 61.

A path inclined in the direction opposite to that for the intermediate stacker 30 is formed by conveyance belt 62 arranged to be inclined, first guide plate 63 that faces the conveyance belt 62 and by paired second guide plates 64. On the second guide plates 64, there is provided stopper 65 which can be adjusted in terms of position in the feeding direction for sheet S. Further, there is arranged knife-shaped folding member 661 having folding tip portion 661A, between the first guide plate 63 and the second guide plates 64. The folding member 661 is fixed on U-shaped connecting member 676. The connecting member 676 is guided to advance straight by guide bar 675 that is fit with the connecting member 676. Gear 673 is engaged with worm gear 672 that is driven by motor 671, and link 674 converts the rotational motion of the gear 673 into the linear motion. Under the driving mechanism as stated above, the folding member 661 is driven by the motor 671 to conduct the reciprocating motion shown with arrows in dotted and solid lines in FIG. 3.

In the moving direction of the folding tip portion 661A, there are arranged folding roller R1 and folding roller R2 each being covered with a material such as rubber having high friction resistance so that they face each other. Both ends of the folding roller R1 are supported by a pair of supporting plates 640 supported on supporting shaft 644 that is supported on the finishing apparatus FS. Both ends of the folding roller R2 are supported by a pair of supporting plates 645 supported on supporting shaft 648 that is supported on the finishing apparatus FS. By virtue of springs 643 and 647 provided respectively on the supporting plate 640 and the supporting plate 645, the folding roller R1 and the folding roller R2 are in pressure contact with each other.

Further, for receiving sheets S folded by the folding roller R1 and the folding roller R2 and for folding the sheets S, there are arranged folding roller R4, folding roller R5 and conveyance roller R3 each being covered with a material such as rubber having high friction resistance. Among them, the folding roller R4 is supported directly on the finishing apparatus FS. The folding roller R4 is a driving roller which is driven by an unillustrated driving source to convey sheet S. The conveyance roller R3 arranged to face the folding roller R4 is supported, on its both ends, by a pair of supporting plates 649 supported by supporting shaft 652 that is supported on the finishing apparatus FS, and the conveyance roller R3 is brought into pressure contact with the folding roller R4 by sprint 651. Thus, the sheet S is conveyed while it is regulated in the fixed direction, and it is folded firmly so that the stiffness of the sheet S is improved and conveyance thereof is secured.

Further, stop guide plate 655A that is positioned inside supporting plates 649 and 650 and guides fold section SA to stop it temporarily is provided in the finishing apparatus FS.

In addition, the folding roller R5 that comes in contact with the folding roller R4 is supported, on its both ends, by a pair of supporting plates 653 supported by supporting shaft 655 that is supported on the finishing apparatus FS, and the folding roller R5 is provided so that it is brought into contact with the folding roller R4 by spring 656, thus, the second folding means 68 is formed by the second sheet folding rollers R4 and R5.

Each of the numerals 658 and 659 is a detecting member which detects that sheet S has passed through the first guide plate 63 and the second guide plate 64, and the numeral 657 is a sheet ejection guide plate which guides sheet S folded by folding rollers R4 and R5 and ejected to the outside of the apparatus.

A folding process will be explained, referring to FIG. 4. Each of FIG. 4(*a*) and FIG. 4(*b*) shows a first folding process to fold with a first folding means 67, and FIG. 4(*c*) shows a second folding process to fold with a second folding means 68.

In the process of folding in three, sheet S is conveyed first between the first guide plate 63 and the conveyance belt 631, and then, is conveyed into the second guide plate 64. Then, the leading edge of the sheet S hits stopper 65 adjusted in terms of position with a size of the sheet S, and the sheet S stops. Next, motor 671 shown in FIG. 3 rotates to drive gear 673 to rotate, so that folding member 661 is moved in the direction of an arrow in solid lines in FIG. 3 and FIG. 4(*a*), and a fold is made by the folding tip portion 661A at the prescribed position of the sheet S.

As shown in FIG. 4, sheet S is folded by the folding tip portion 661A and fold section SA is formed while folding rollers R1 and R2 are rotating respectively in the directions of arrows of solid lines. As shown in FIG. 4(*b*), therefore, the fold section SA is conveyed through the clearance between the folding roller R1 and the folding roller R2, while the folding member 661 is moved by motor 761 in the direction of an arrow of a dotted line to return to the initial position.

Next, as shown in FIG. 4(*c*), the fold section SA is conveyed by conveyance roller R4 and conveyance roller R3 rotating respectively in the directions of arrows of solid lines until it is stopped by stop guide member 655A. Under the state that the fold section SA is prevented from advancing by the stop guide member 655A, when the folding roller R4 further rotates in the direction shown with a solid line, an unfolded portion of the sheet S is conveyed by the folding roller R4 to be interposed between folding rollers R5 and R4, thus, the sheet S is folded to form fold section SB.

Thus, the sheet S folded in three having the fold section SA formed by the folding rollers R1 and R2 and the fold section SB formed by the folding rollers R4 and R5 passes through sheet ejection guide plate 657 to be ejected onto fixed sheet ejection tray 93.

As explained above, the sheet S is folded in three at the folding means 60, and is ejected onto the fixed sheet ejection tray 93. It is ordinary that the folding in three is applied on a document for a sealed letter. In the embodiment explained above, it is possible to conduct folding processing with a small-sized finishing apparatus capable of being installed on image forming apparatus main body A. In the case of a postal sealed document, therefore, it is possible to prepare a document in a form suitable for a sealed letter, while recording information that is different for each document such as an address on the document.

Figure 5:
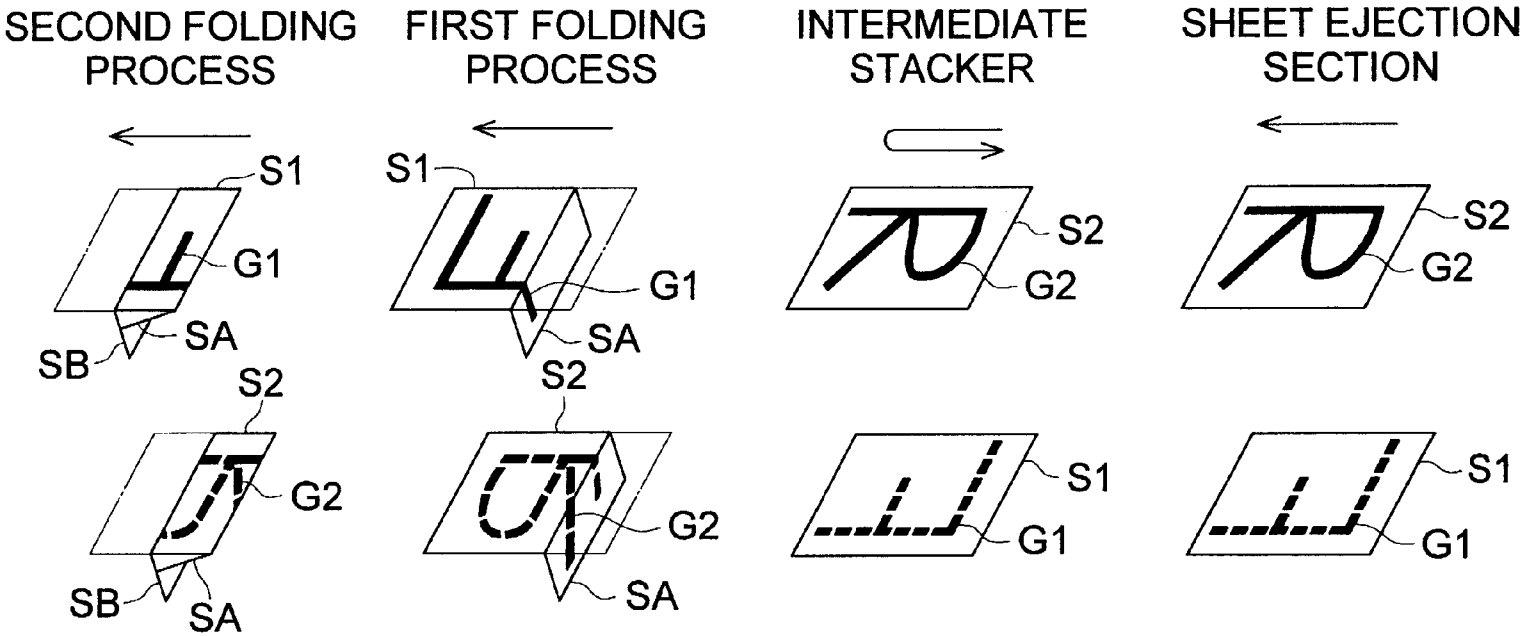
FIGS. 5(*a*)–5(*d*) are diagrams showing relationships between sheet S and an image direction in image forming and folding processing.

FIG. 5 shows relationship of a direction between sheet S and an image in image forming and folding processing. In FIG. 5, obverse S1 and reverse S2 both of sheet S are separated in the illustration, and a visible image is shown with solid lines, while an image which is invisible because it is on the reverse side is shown with dotted lines.

From sheet ejection section 8 of the image forming apparatus main body A, there is conducted sheet ejection for sheet S shown with an arrow wherein image G2 on the reverse is on the upper side and image G1 on the obverse is on the lower side as shown in FIG. 5(*a*), and the upper portion of the image represents a trailing edge of the sheet S in its conveyance direction.

Sheet S having an obverse, a reverse and a direction of an image shown in FIG. 5(*a*) is prepared in the image forming apparatus main body A under the following control for writing of the image.

When a mode of folding in three is set on selection button Md (shown in FIG. 7) representing a selecting means provided on an operating section of an image forming apparatus, there are established image forming conditions exemplifying, for example, that a longer side of a sheet in a prescribed size such as an A4 size needs to be in the conveyance direction. Then, in image forming on the obverse, writing is started from the upper portion of the image. In image forming on the reverse to be conducted following the image forming on the obverse, writing is started from the lower portion of the image, resulting in image forming wherein an upper portion of an image on the reverse is formed on the trailing edge of sheet S. In this way, the sheet S shown in FIG. 5(*a*) is prepared.

Incidentally, when forming an image on a single side in the mode of folding in three, writing is started from an upper portion of the image, and the upper portion of the image is formed on the leading edge of sheet S to be conveyed. Then, the sheet S is inverted in terms of obverse and reverse and is ejected at sheet ejection section 8, to be fed into finishing apparatus FS.

In the finishing apparatus FS, switchback conveyance is conducted as shown with an arrow on intermediate stacker 30, resulting in inversion of a sheet in terms of a leading edge and a trailing edge, and in the conveyance wherein an upper portion of an image comes to a leading edge of the sheet to be conveyed, and then, the sheet is fed into folding means 60 (FIG. 5(*b*)).

In the first folding process, there is conducted folding processing to form fold section SA at the position that is about ⅓ of the total length of the sheet S from its trailing edge so that obverse S1 may be convex as shown in FIG. 5(*c*). Finally, there is conducted folding processing to form fold section SB at the position that is about ⅓ of the total length of the sheet S from its leading edge so that obverse S1 may be convex in the second folding process shown in FIG. 5(*d*). Thus, there is finished a folded document wherein the leading edge portion of image G1 on obverse S1 comes to the outermost portion of the folded sheet S. thereby, indexes and titles of a document can be looked at a glance.

Next, operations of folding means 60 in the case of two-folding processing will be explained, referring to FIGS. 6(*a*) and 6(*b*). FIGS. 6(*a*) and 6(*b*) are diagrams showing operations of main portions of folding means 60 in the case of folding in two.

In the two-folding processing, stop guide plate 655A is rotated counterclockwise (shown with arrows in FIG. 6(*b*)) around shaft 655B representing a rotating center to be changed from the state shown in FIG. 4(*c*) to the state shown in FIG. 6(*b*) wherein a sheet accepting portion on the lower end of the stop guide plate 655A is retreated from the sheet conveyance path.

As shown in FIG. 3, sheet S conveyed to the folding means 60 is subjected to folding by folding tip portion 661A so that fold section SC may be formed, and the fold section SC is fed into the space between folding rollers R1 and E2.

The folding rollers R1 and R2 convey the fold section SC, and the fold section SC thus conveyed is guided by guide plate 655D as shown in FIG. 6(*b*) to be ejected onto fixed sheet ejection tray 93.

Though the foregoing is explanation of folding processing for only one sheet S, it is also possible to collect a plurality of sheets S by stopper 52, and to conduct folding in three or folding in two for the collected sheets S.

Figure 7:
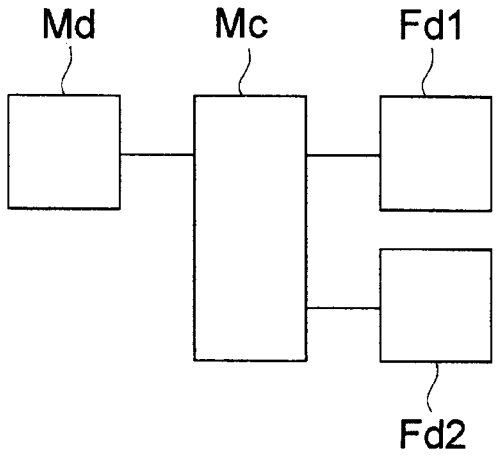
FIG. 7 is a block diagram of a control system of an image forming apparatus related to an embodiment of the invention.

FIG. 7 is a block diagram of a control system of an image forming apparatus wherein a mode of folding in two and a mode of folding in three can be used after selected. On the operation panel (not shown) of the image forming apparatus, there is provided mode selection button Md representing a selecting means to select the aforesaid mode for folding a sheet in two or the mode for folding a sheet in three. When the mode for folding in two is selected by the mode selection button Md, control means Mc controls so that the first folding means Fd1 only is operated and a sheet is folded in two as stated above. When the mode for folding in three is selected by the mode selection button Md, the control means Mc controls so that the first folding means Fd1 is operated and a sheet is folded as stated above, and then, the second folding means Fd2 is operated and the sheet is folded.

In the embodiment explained above, knife-shaped folding member 661 is used as the first folding means, and stop guide member 655A is used as the second folding means. However, any one of these knife-shaped folding member 661 and stop guide member 655A can be used optionally for either one of the first folding means and the second folding means.

(3) Embodiment 2

Figure 8:
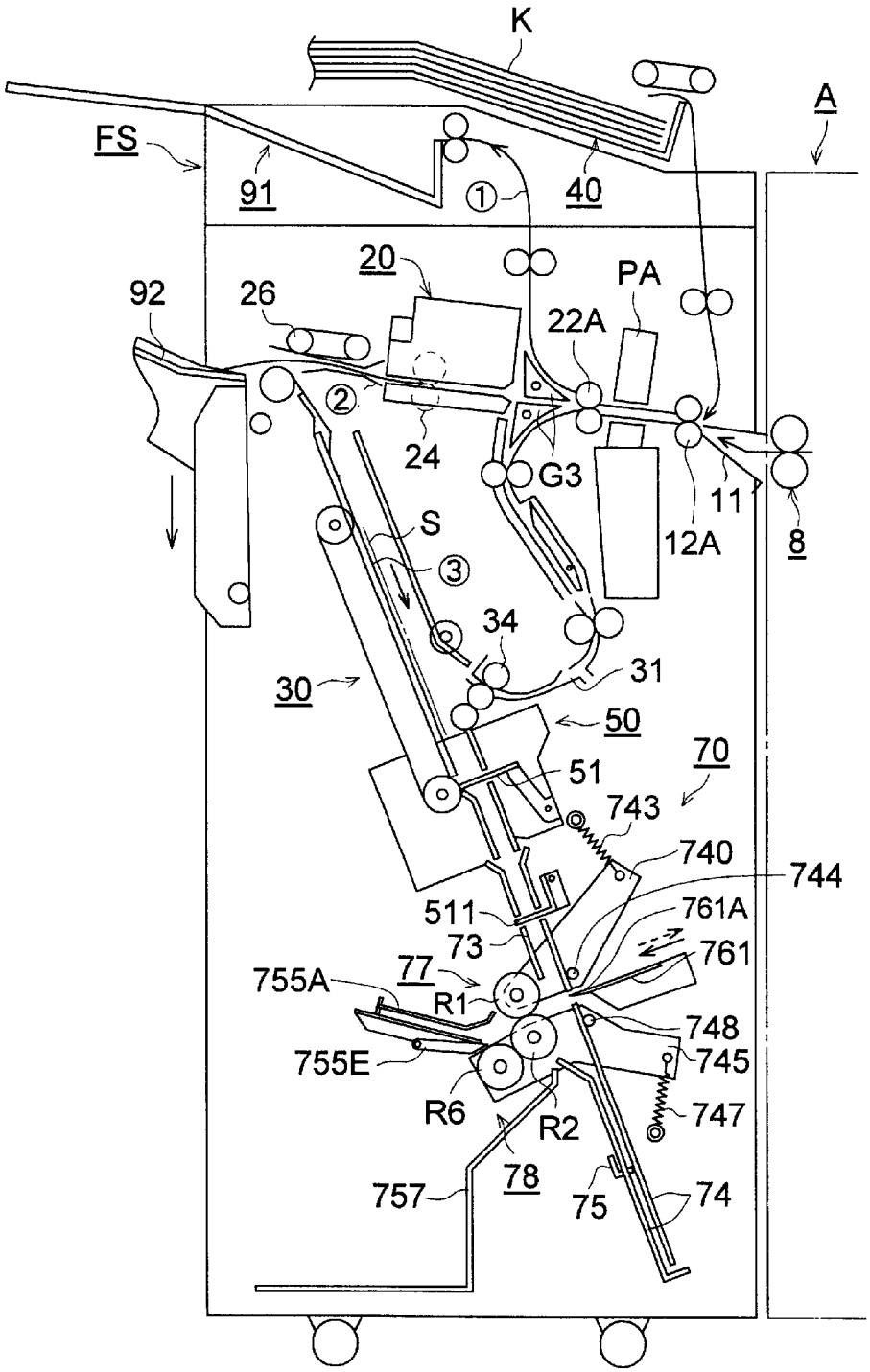
FIG. 8 is a diagram showing the structure of a finishing apparatus related to Embodiment 2 of the invention.

FIG. 8 is a diagram showing the structure of finishing apparatus FS which is related to Embodiment 2 of the invention and is connected with image forming apparatus main body A in FIG. 1.

A position and a height are adjusted for installation so that accepting section 11 for sheet S ejected out of image forming apparatus main body A may agree, in terms of position, with sheet ejection section 8 of the image forming apparatus main body A.

Paired rollers 12A are provided at an entrance of the accepting section 11, and a conveyance path for sheet S connected at the downstream side in the sheet conveyance direction is composed of first conveyance path (1) which is for sheet ejection mainly for the upper deck, second conveyance path (2) for the medium deck and third conveyance path (3) for the lower deck, so that sheet S is fed to either one of the conveyance paths through switching gate G3.

(3)-1. Simple Sheet Ejection

The image-formed sheet S ejected out of image forming apparatus main body A is guided into accepting section 11, and passes through paired rollers 12A and perforating means PA to be conveyed. Switching gate G3 is positioned at the lower portion, and the sheet S is guided by the upper surface of the switching gate G3 to be fed into the first path (1) and is ejected onto fixed sheet ejection tray 91 located on the upper portion of the apparatus to be stacked successively. When making holes on sheet S, perforating means PA is operated.

The fixed sheet ejection tray 91 stated above is constructed so that a maximum of about 200 sheets S can be stacked.

(3)-2. Shift Processing

In this conveyance mode, switching gate G3 goes up to guide sheet S so that the sheet S may pass through the space between two guide members constituting the switching gate G3 as shown with solid lines in FIG. 8. The image-formed sheet S ejected out of the image forming apparatus main body A is conveyed by paired rollers 12A, then passes through the switching gate G3, and is conveyed by paired rollers 24. The sheet S thus conveyed is ejected by ejection roller 26 onto fluctuating sheet ejection tray 92 located outside the apparatus to be stacked in succession. Shift processing section 20 conducts shift processing to change the position of sheet ejection for sheet S in the conveyance transverse direction, at an interval of the prescribed number of sheets.

This fluctuating sheet ejection tray 92 is constructed to descend gradually in the direction shown with a one-dot-chain line, when ejecting a large number of sheets S, and it can take in a maximum of about 3000 sheets S (A4, B5).

(3)-3. Binding Processing

In the course of binding processing, switching gate G3 is on the uppermost position, and sheet S is guided by the bottom surface of the switching gate G3 to advance to the third conveyance path (3).

In the third conveyance path (3), sheet S which has passed through path 31 is conveyed by paired rollers 34 to move to the upper portion of intermediate stacker 30 that is arranged to be inclined. After the trailing edge of the sheet S has passed the paired rollers 34, the sheet S released from the paired conveyance rollers 34 falls along the surface of the intermediate stacker 30 until it hits movable stopper 51 provided on stapler 50 to stop.

When appending a cover to sheet S, cover K is supplied to intermediate stacker 30 from cover feeding means 40.

When a bundle of sheets S in quantity of prescribed number or a bundle of sheets S and cover K are stacked on intermediate stacker 30, stapling means 50 conducts binding processing to staple a staple. A bundle of bound sheets S is conveyed by a conveyance device of intermediate stacker 30 to be ejected onto fluctuating sheet ejection tray 92.

(3)-4. Folding Processing

In the present embodiment, folding means 70 is arranged to parallel the third conveyance path (3) that is inclined to be the same as intermediate stacker 3 constituting a binding means.

The folding means 70 that conducts folding in three or folding in two has first folding means 77 composed of folding roller R1 representing a first folding roller that constitutes a first conveyance and folding means, folding roller R2 representing a second folding roller that constitutes a first conveyance and folding means, and of knife-shaped folding member 761, and second folding means 78 composed of folding roller R2 representing a second folding roller that constitutes a second conveyance and folding means, folding roller R6 representing a third folding roller that constitutes a second conveyance and folding means, and of stop guide member 755A.

First guide plate 73 and second guide plate 74 are provided respectively under movable stoppers 51 and 511 which make sheet S on intermediate stacker 30 to fall downward and the intermediate stacker 30, and on the second guide plate 74, there is provided stopper 75 that can adjust a position to the feeding direction for sheet S. Further, on the first guide plate 73 and second guide plate 74, there is arranged knife-shaped folding member 761 having folding tip portion 761A, and on the folding member 761, there is provided a driving mechanism that is the same as that in FIG. 3 to move the folding member 761 in the directions of the solid line arrow and in the directions of the dotted line arrow.

In the moving direction of the folding member 761, there are arranged folding roller R1 and folding roller R2 each being covered with a material such as rubber having high friction resistance so that they face each other. Both ends of the folding roller R1 are supported by a pair of supporting plates 740 supported on supporting shaft 744 that is supported on the finishing apparatus FS. Both ends of the folding roller R2 are supported by a pair of supporting plates 745 supported on supporting shaft 748 that is supported on the finishing apparatus FS. By virtue of springs 743 and 747 provided respectively on the supporting plate 740 and the supporting plate 748, the folding roller R1 and the folding roller R2 are in pressure contact with each other, and first folding means 77 is composed of the folding member 761, the first folding roller R1 and of the second folding roller R2.

In addition, second folding means 78 is formed by the folding roller R2 and folding roller R6 which is in pressure contact with the folding roller R2. The folding roller R6 is supported by supporting plates 745 and 746, and is constituted to be brought into pressure contact with the folding roller R2 each other by a spring.

Further, stop guide plate 755A constituted solidly by two plates is provided on finishing apparatus FS so that the stop guide plate 755A is positioned inside supporting plates 749 and 750 to stop the folded sheet S temporarily. Conveyance switching member 755E is further provided under the stop guide plate 755A to guide sheet S into the stop guide plate 755A or to guide sheet A to be ejected directly. The numeral 757 represents a sheet ejection guide plate that guides the folded and ejected sheet S1 to the outside of the apparatus.

Figure 9:
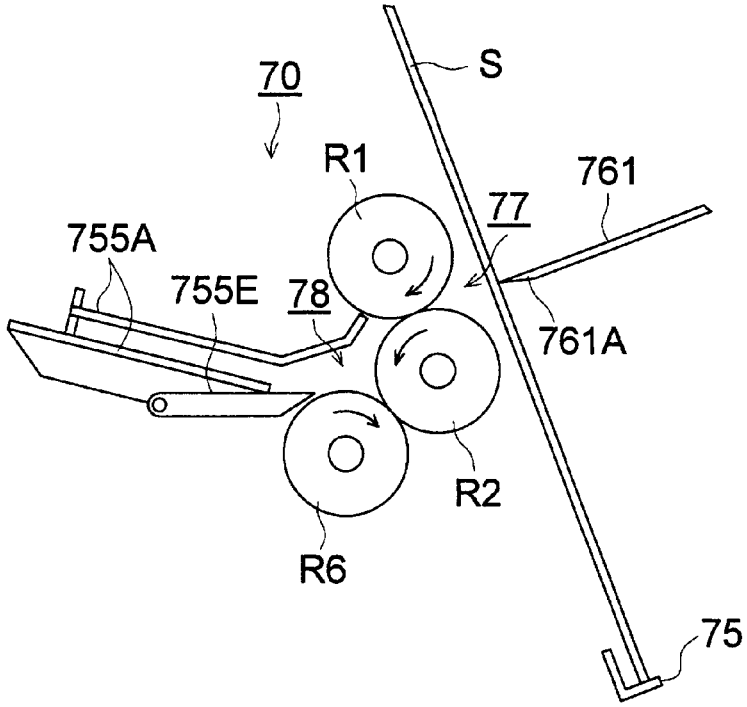
FIGS. 9(*a*) and 9(*b*) are diagrams showing operations of main portions of a folding means in the case of folding in three.
Figure 9:
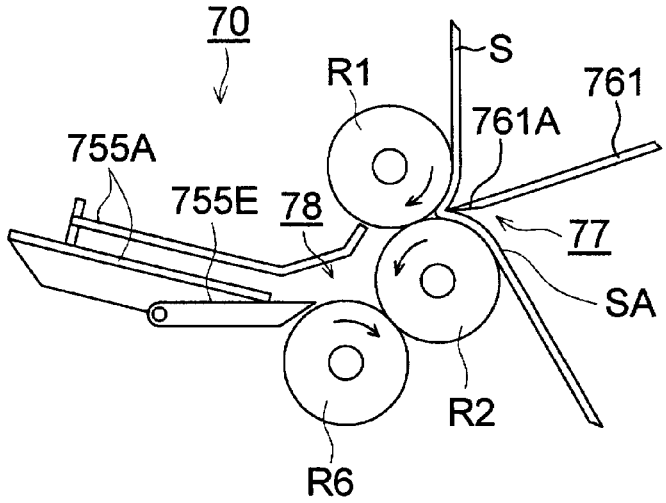

Each of FIGS. 9(*a*) and 9(*b*) shows operations of the first folding means 77 in the first folding process, and each of FIGS. 10(*a*) and 10(*b*) shows operations of the second folding means 78 in the second folding process.

First, in FIG. 9, sheet S is fed to the first guide plate 73 and to the second guide plate 74. Then, the sheet S stops with its leading edge hitting stopper 75 that is positionally adjusted to the size of the sheet S, as shown in FIG. 9(*a*).

Next, as shown in FIG. 9(*b*), folding tip portion 761A inserts fold section SA formed on the sheet S into the space between the folding roller R1 and the folding roller R2. In this case, the folding rollers R1 and R2 are rotating in the directions respectively of their solid line arrows, and they nip the sheet S between them while forming the fold section SA. At this moment, the conveyance switching member 755E is suspended at the position where the stop guide plate 755A is opened.

Next, as shown in FIG. 10(*a*), the sheet S whose fold section SA is formed between the folding rollers R1 and R2 is conveyed in the direction of a solid line arrow, while, folding member 761 moves as shown with a dotted line to return to the starting position. Then, the sheet S is conveyed until the fold section SA is retarded in the guide plate 755A.

Next, as shown in FIG. 10(*b*), the folding rollers R1 and R2 further rotate, and thereby, fold section SB of the sheet S is conveyed to second folding means 78 that is formed by the folding roller R2 having the greater friction resistance and by folding roller R6, thus, fold section SA and fold section SB are formed, and sheet S folded in three whose leading edge and trailing edge are folded passes through the second folding means 78. The sheet S folded in three by the folding rollers R2 and R6 is ejected to sheet ejection guide plate 757.

Figure 11:
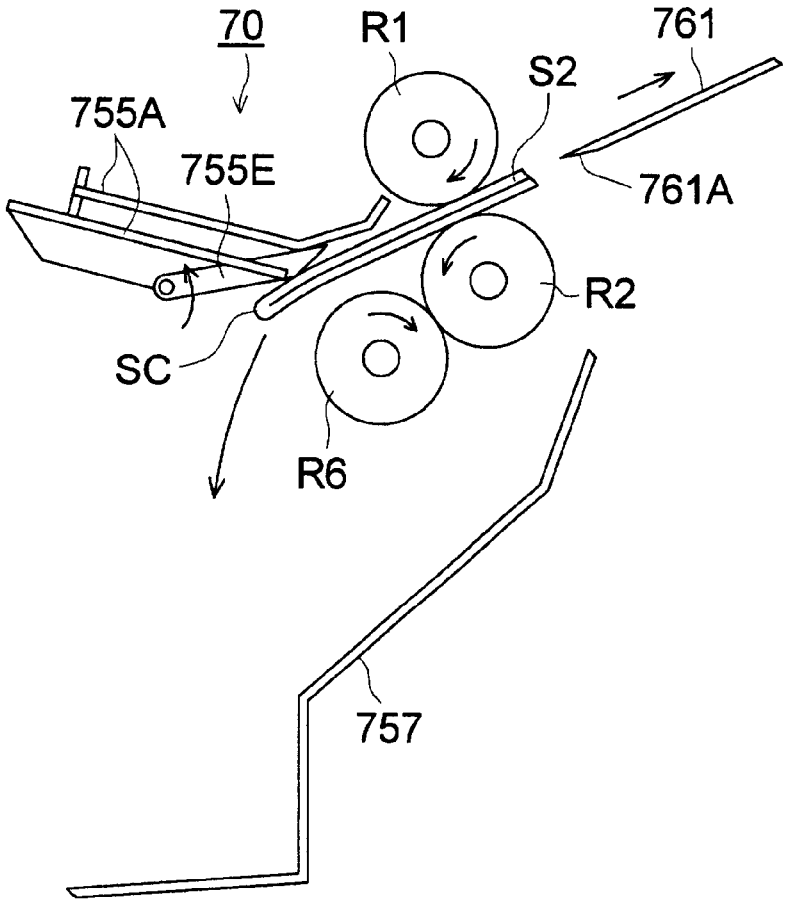
FIG. 11 is a diagram showing operations of main portions of a folding means in the case of folding in two.

Next, operations of folding means 70 for folding sheet S in two will be explained as follows, referring to FIG. 11 which is a diagram showing main operations of the folding means 70 for folding in two.

In the same way as in the occasion of folding in three, folding member 761 inserts sheet S into the space between the folding rollers R1 and R2 to form fold section SC. The folding rollers R1 and R2 rotate as shown by solid line arrows in FIG. 10 to convey fold section SC. In the folding processing to fold in two, conveyance switching member 755E rotates counterclockwise as shown with an arrow to shut an entrance of stop guide plate 755A. By virtue of this, the fold section SC does not enter the stop guide plate 755A and is guided to be ejected to the outside.

(4) Embodiment 3

Figure 12:
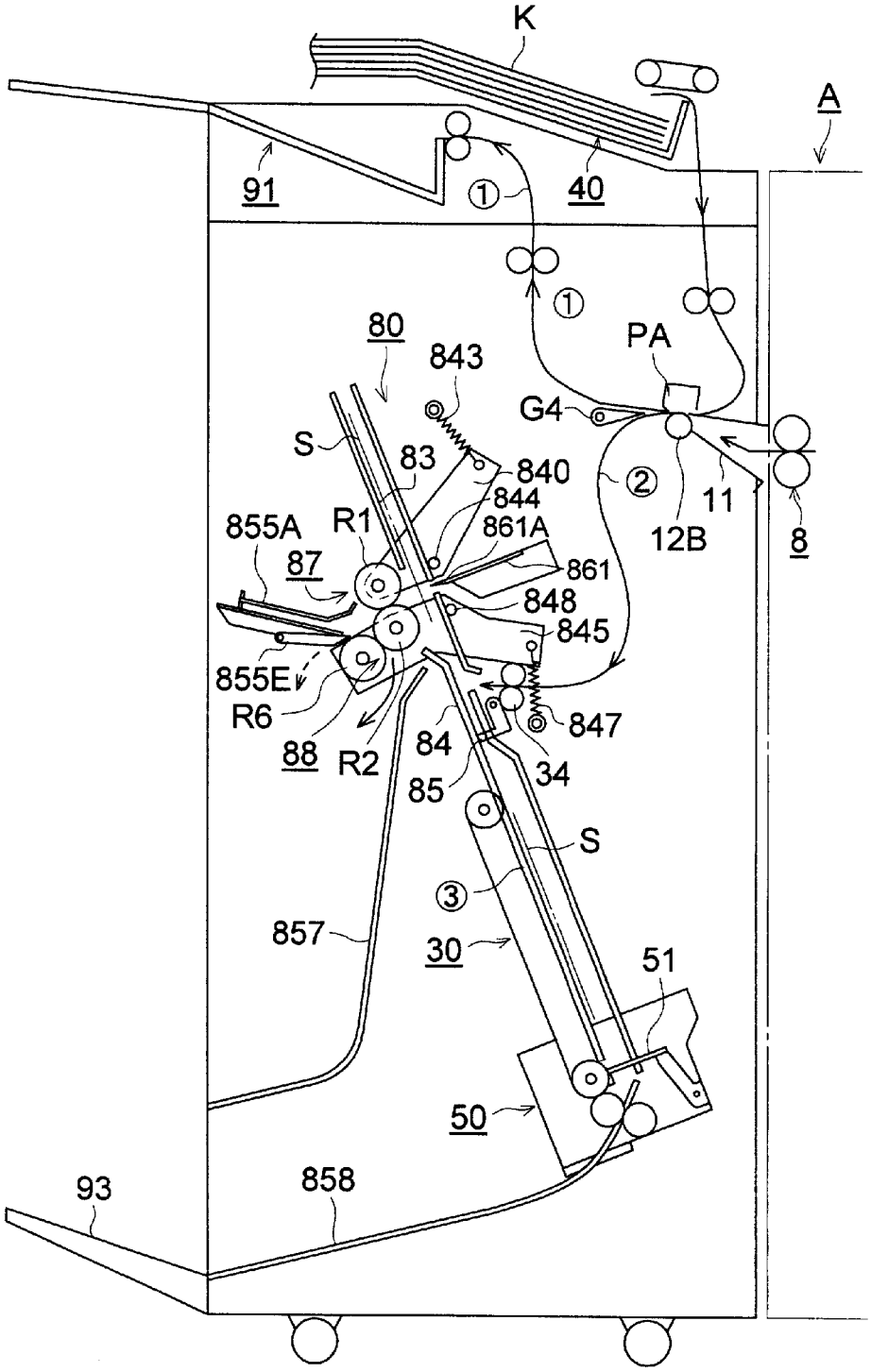
FIG. 12 is a diagram showing the structure of a finishing apparatus related to Embodiment 3 of the invention.

FIG. 12 is a diagram showing the structure of finishing apparatus FS related to the embodiment of the invention.

This finishing apparatus FS is of the structure that is mostly the same as that of finishing apparatus FS shown in FIG. 8.

In the present embodiment, folding means 80 is arranged over a binding means. The folding means 80 has first folding means 87 composed of folding roller R1 representing a first folding roller that constitutes a first conveyance and folding means, folding roller R2 representing a second folding roller that constitutes a first conveyance and folding means, and of knife-shaped folding member 861, and second folding means 88 composed of folding roller R2 representing a second folding roller that constitutes a second conveyance and folding means, folding roller R6 representing a third folding roller that constitutes a second conveyance and folding means, and of stop guide member 855A.

The finishing apparatus FS in FIG. 12 is connected with image forming apparatus main body A so that it may agree with sheet ejection section 8 of the image forming apparatus main body A in FIG. 1.

On an entrance of accepting section 11, there are provided perforating means PA and conveyance roller 12B, and a conveyance path for sheet S connected at the downstream side in the sheet conveyance direction is composed mainly of first conveyance path (1) that is mainly for sheets on the upper deck, second conveyance path (2) for the medium deck and third conveyance path (3) for the lower deck.

(4)-1. Simple Sheet Ejection

Image-formed sheet S ejected out of image forming apparatus main body A is guided into accepting section 11, and it passes through conveyance roller 12B and perforating means PA to be conveyed. The sheet S is guided by switching gate G4 to enter the conveyance path (1), and is ejected onto fixed sheet ejection tray 91 positioned at the upper portion of the apparatus to be stacked in succession. When making holes on sheet S, perforating means PA is operated.

The fixed sheet ejection tray 91 can take in a maximum of about 200 sheets S which can be taken out easily from the upper portion of finishing apparatus FS.

(4)-2. Binding Processing

Sheet S which has been subjected to image forming processing in image forming apparatus main body A and has been fed to accepting section 11 of finishing apparatus FS passes through conveyance roller 12B, and then, is guided downward by gate G4 that is switched to the upper position, to enter the second conveyance path (2).

In the second conveyance path (2), the sheet S is conveyed by paired rollers 34 to be fed out upward, and thereby, the sheet S goes up along intermediate stacker 30 arranged obliquely. After the trailing edge of the sheet S in its advancement direction has passed the paired rollers 34, the sheet S is released to fall along the intermediate stacker 30 until it hits movable stopper 51 provided on stapling means (binding means) 50 to be stopped.

When appending cover K to sheets S in intermediate stacker 30, the cover K is supplied to the intermediate stacker 30 from cover supplying means 40.

When prescribed number of sheets S or cover K and sheets S are stacked on intermediate stacker 30, stapler 50 conducts stapling processing at the prescribed position on the sheets S. A bundle of bound sheets is ejected onto fixed sheet ejection tray 93 located at the lower portion through sheet ejection path 858.

(4)-3. Folding Processing

Folding means 80 is arranged at the upper portion of a binding means, in the present embodiment.

The folding means 80 conducting folding in three or folding in two has first folding means 87 composed of folding roller R1 representing a first folding roller that constitutes a first conveyance and folding means, folding roller R2 representing a second folding roller that constitutes a first conveyance and folding means, and of knife-shaped folding member 861, and second folding means 88 composed of folding roller R2 representing a second folding roller that constitutes a second conveyance and folding means, folding roller R6 representing a third folding roller that constitutes a second conveyance and folding means, and of stop guide member 855A.

To guide sheet S in the upper position of intermediate stacker 30, first guide plate 83 and second guide plate 84 are provided almost vertically on the upper portion of the intermediate stacker 30. On the second guide plate 84, there is provided stopper 85 which can adjust a position to the direction of feeding sheet S. In addition, folding member 861 having thereon folding tip portion 861A is arranged between the first guide plate 83 and the second guide plate 84, and a driving mechanism which is the same as that in FIG. 3 is provided on the folding member 861 to make it to conduct the reciprocation motion.

In the moving direction of the aforesaid folding member 861, there are arranged folding roller R1 and folding roller R2 each being covered with a material such as rubber having high friction resistance so that they face each other. Both ends of the folding roller R1 are supported by a pair of supporting plates 840 supported on supporting shaft 844 that is supported on the finishing apparatus FS. Both ends of the folding roller R2 are supported by a pair of supporting plates 845 supported on supporting shaft 848 that is supported on the finishing apparatus FS. By virtue of springs 843 and 847 provided respectively on the supporting plate 840 and the supporting plate 845, the folding roller R1 and the folding roller R2 are provided to be in pressure contact with each other, and first folding means 87 is formed.

In addition, folding roller R6 that receives sheet S folded by folding rollers R1 and R2 and is covered by a material having high friction resistance such as rubber for folding sheet S is arranged to face and to be in contact with folding roller R2, and thus second folding means 88 is formed The folding roller R6 is supported by supporting plates 845 and 846, and is constituted to be brought into pressure contact with the folding roller R2 by a spring.

Further, stop guide plate 755A constituted solidly by two plates is provided on finishing apparatus FS so that the stop guide plate 755A is positioned inside supporting plates 749 and 750 to stop the folded sheet S temporarily. Conveyance switching member 755E is further provided under the stop guide plate 755A to guide sheet S into the stop guide plate 755A or to guide sheet A to be ejected directly. The numeral 757 represents a sheet ejection guide plate that guides the folded and ejected sheet S1 to the outside of the apparatus.

In the same way as in the folding means 70 shown in FIG. 8, processing for folding in three is conducted in the first folding means 87 and the second folding means 88, and processing for folding in two is conducted in the first folding means 87.

According to the present invention, the following effects can be attained.

It becomes possible for an image forming apparatus equipped with a finishing apparatus having a folding function to be small in size and to have functions of folding in two and of folding in three, because a folding means can be made small.

Further, it becomes possible to realize an image forming apparatus equipped with a small-sized finishing apparatus wherein a function of folding in two and a function of folding in three can be used selectively in case of need.

Still further, it becomes possible to realize a small-sized image forming apparatus provided with a folding function having functions of binding, folding in two and folding in three.

Still further, it becomes possible to realize a small-sized image forming apparatus which can fold a bundle of a plurality of sheets in two or in three.

Still further, it becomes possible for a small-sized processing apparatus to conduct folding in two and folding in three.

Still further, according to the present invention, it is possible that an image is formed on a sheet, and there is conducted efficiently the folding wherein a small-sized folding means in which a folding means is arranged in a conveyance path for an image-formed sheet is used, and a portion of a document which is looked exceedingly, namely, an upper portion of the image on the obverse appears on the outermost side of the folded document.

Still further, it becomes possible to fold a document in two.

Still further, it becomes possible to incorporate a small-sized means for folding processing in a finishing apparatus.

Still further, according to the present invention, it is possible that two-sided image forming is conducted, and a document folded in three is made in the form wherein information to be looked exceedingly is recorded on the position that is easiest to see.

Still further, it becomes possible to realize a small-sized image forming apparatus having functions to fold in three and to bind.

Disclosed embodiment can be varied by a skilled person without departing from the spirit and scope of the invention.

What is claimed is:

1. An image forming apparatus, comprising:

a first folding device and a second folding device, both of which conduct folding processing while conveying a sheet;

a controller to control both of said first folding device and said second folding device; and a selector to select a two-folding mode or a three-folding mode;

wherein said controller controls said first folding device so as to eject said sheet after folding said sheet double when said two-folding mode is selected by said selector, while said controller controls said first folding device so as to fold said sheet double, and then, further controls said second folding device so as to eject said sheet after further folding said sheet in three when said selector selects said three-folding mode; and wherein said first folding device comprises:

a first conveyance-folding device that conveys said sheet; and a knife-shaped folding member to feed said sheet into said first conveyance-folding device in a state that a folded portion of said sheet is at a forefront, and wherein said second folding device comprises:

a second conveyance-folding device that folds and conveys said sheet; and a stop guiding member to stop a leading edge of said sheet conveyed by said second conveyance-folding device.

2. The image-forming apparatus of claim 1, wherein said stop guiding member guides said sheet along a conveyance path of said sheet in a three-folding process, and said stop guiding member retreats from said conveyance path in a two-folding process.

3. The image-forming apparatus of claim 1, further comprising a binding device, wherein said binding device, said first folding device and said second folding device are successively arranged in a conveyance direction of said sheet.

4. The image-forming apparatus of claim 3, wherein said binding device comprises an inclined intermediate stacker, and said first folding device is arranged along a conveyance path that is inclined in a direction opposite to that of said intermediate stacker.

5. The image-forming apparatus of claim 3, wherein said binding device comprises an inclined intermediate stacker, and said first folding device is arranged along a conveyance path that is inclined in a same direction as that of said intermediate stacker.

6. The image-forming apparatus of claim 1, further comprising a binding device arranged on a downstream side in a conveyance path of said sheet with respect to said first folding device.

7. The image-forming apparatus of claim 1, further comprising a stacking member disposed on an upstream side of said first folding device for stacking a plurality of sheets thereon.

8. A finisher for finishing a sheet on which an image is formed, comprising:

a first folding roller;

a second folding roller contacting said first folding roller;

a knife-shaped folding member to insert a folded portion of said sheet into a nip formed between said first folding roller and said second folding roller;

a third folding roller contacting said second folding roller at a downstream side of said first folding roller in a conveyance direction of said sheet; and a stopper guide member to stop said sheet conveyed by said second folding roller;

wherein a combination of said first folding roller, said second folding roller and said knife-shaped folding member folds said sheet as a first folding process, while a combination of said second folding roller, said third folding roller and said stopper guide member folds said sheet as a second folding process.

9. A finisher for finishing a sheet on which an image is formed, comprising:

a first folding roller;

a second folding roller contacting said first folding roller;

a third folding roller;

a conveyance roller contacting said third folding roller;

a knife-shaped folding member to insert a folded portion of said sheet into a nip formed between said first folding roller and said second folding roller;

a fourth folding roller contacting said third folding roller at a downstream side of said conveyance roller; and a stopper guide member to stop said sheet conveyed by said third folding roller and said conveyance roller, wherein a combination of said first folding roller, said second folding roller and said knife-shaped folding member folds said sheet as a first folding process, while a combination of said third folding roller, said fourth folding roller, said conveyance roller and said stopper guide member folds said sheet as a second folding process.

* * * * *